United States Patent [19]

Lenz

[11] 4,265,282

[45] May 5, 1981

[54] TUBULAR ROTATING CUTTER

[75] Inventor: John O. Lenz, Coon Rapids, Minn.

[73] Assignee: Kurt Manufacturing Company, Inc., Minneapolis, Minn.

[21] Appl. No.: 93,188

[22] Filed: Nov. 13, 1979

[51] Int. Cl.[3] ..... B27G 13/00

[52] U.S. Cl. ..... 144/219; 407/54

[58] Field of Search ..... 407/54, 53, 57, 62, 407/34, 42; 144/219, 218

[56] References Cited

U.S. PATENT DOCUMENTS

| | | | |
|---|---|---|---|
| 207,743 | 9/1878 | Huff | 144/219 |
| 740,506 | 10/1903 | Winquist | 144/219 |
| 788,873 | 5/1905 | Anderson | 144/219 |
| 853,321 | 5/1907 | Richmond | 144/219 |
| 1,063,995 | 6/1913 | Mintz | 407/54 |
| 1,316,959 | 9/1919 | Keiser | 144/219 |
| 1,717,736 | 6/1929 | Salstrom | 144/219 |
| 1,916,874 | 7/1933 | Wilhelm | 407/54 |
| 2,107,787 | 2/1938 | Grumke | 144/219 |
| 2,202,251 | 5/1940 | Gille | 144/219 |

FOREIGN PATENT DOCUMENTS

| | | | |
|---|---|---|---|
| 616787 | 2/1927 | France | 144/219 |

*Primary Examiner*—Leonidas Vlachos

*Attorney, Agent, or Firm*—Kinney, Lange, Braddock, Westman and Fairbairn

[57] ABSTRACT

A cutter for use on wood working tools such as for carving machines which is formed from a tubular segment cut along two planes which are nonparallel and nonperpendicular to the tube axis to provide cutting edges and adequate tool edge clearance, so that the rotating cutting tool can be moved axially along its rotational axis and cut cleanly in this direction as well while moving the tool in direction transverse to the rotational axis.

4 Claims, 8 Drawing Figures

FIG. 1
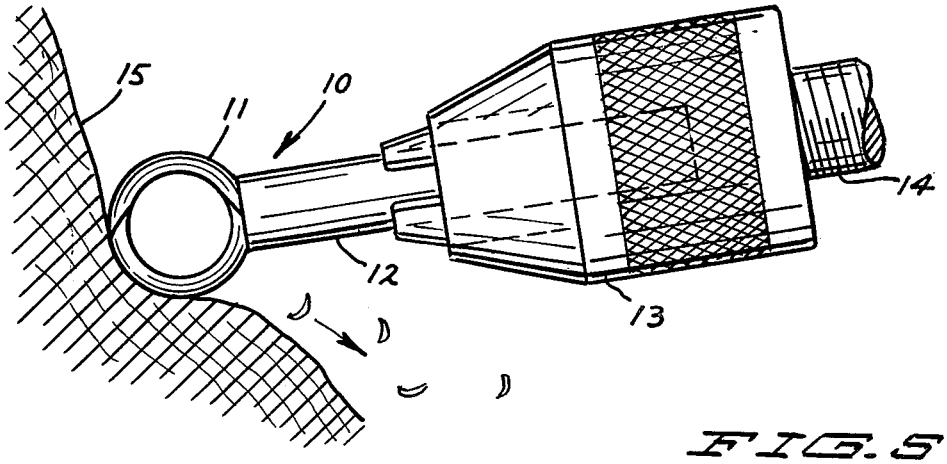
FIG. 2
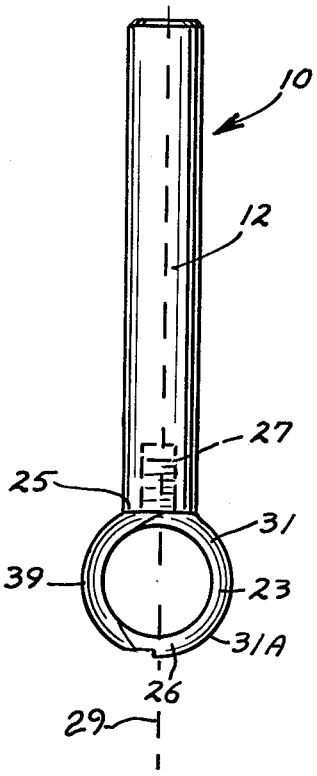
FIG. 3
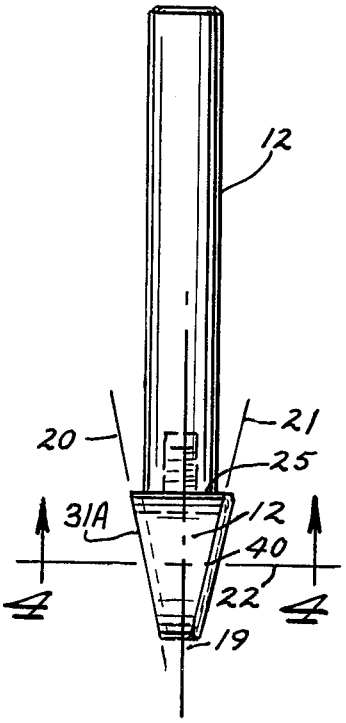
FIG. 5
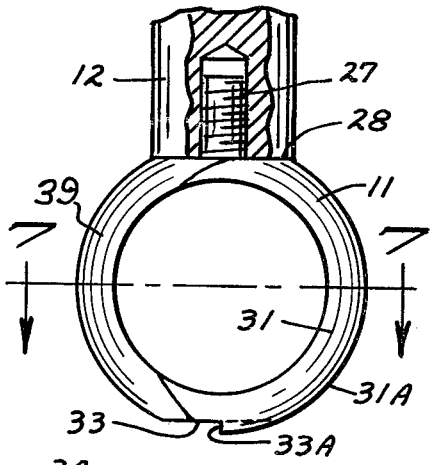
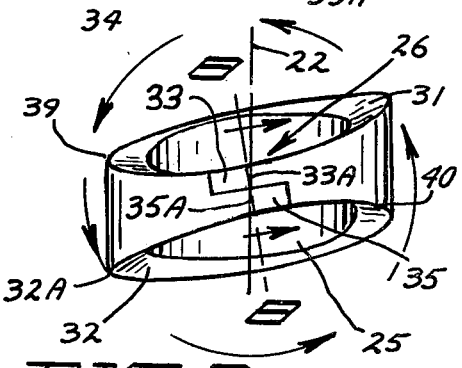
FIG. 6
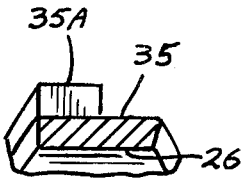
FIG. 8
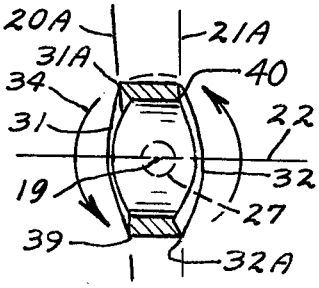
FIG. 4
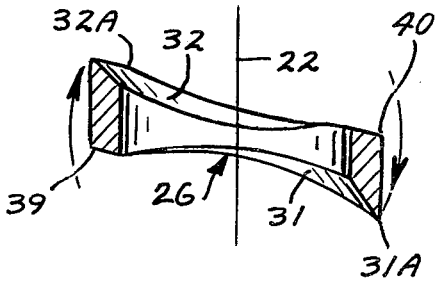
FIG. 7

TUBULAR ROTATING CUTTER

BACKGROUND OF THE INVENTION

1. Field of the Invention

The present invention relates to cutters for use with wood working tools.

2. Prior Art

In the prior art, various rotating cutting tools have been advanced. For example U.S. Pat. No. 1,316,959 shows an annulus formed as a cutting tool and having oppositely disposed sharpened edges. While the overall appearance is similar to the present device, the device in U.S. Pat. No. 1,316,959 does not provide for adequate clearance, and appears to be usable only in directions transverse to the axis of rotation. Tool clearance for compound movements (axial and transverse) used in carving machines also appear to be inadequate.

U.S. Pat. No. 853,321 also shows a similar tool, but it is not made from a tube as in the present invention, although it is formed with two cutters positioned so as to leave a tubular interior.

U.S. Pat. No. 2,107,787 illustrates a cutting tool which has a pair of blade members arranged much like a post hole auger, which blade members have to be assembled onto a rotating support shaft.

Additional patents that illustrate the state of the art include the following patents:

U.S. Pat. No. 207,743
U.S. Pat. No. 740,506
U.S. Pat. No. 788,873
U.S. Pat. No. 1,063,995
U.S. Pat. No. 1,717,736
U.S. Pat. No. 1,916,874
U.S. Pat. No. 2,202,251

The above patents were noted as being of interest during a preliminary search on the subject invention.

SUMMARY OF THE INVENTION

The present invention relates to an annulus formed into a wood cutting tool that provides adequate chip and tool clearance, quick cutting, and clean cutting because of a slicing action with substantially no dead spots in the cutting tool. The annulus is made from a tube section that is sharpened on diagonally opposite edges with respect to the axis of rotation, and which then has cutting edges on the rotationally leading sides of the tube section. Means are provided for fastening the tube section to a shank, such as a threaded connection which is shown specifically.

BRIEF DESCRIPTION OF THE DRAWINGS

FIG. 1 is a side view of the cutter of the present invention shown being used in connection with a drive chuck;

FIG. 2 is a side view of the device of FIG. 1 removed from the chuck;

FIG. 3 is an edge view of the device of FIG. 2;

FIG. 4 is a sectional view taken as on line 4—4 in FIG. 3;

FIG. 5 is an enlarged side view showing the side of the cutting tool illustrated in FIG. 2;

FIG. 6 is a bottom plan view of the device of FIG. 5;

FIG. 7 is a sectional view taken as on line 7—7 in FIG. 5; and

FIG. 8 is a sectional view taken along 8—8 in FIG. 6.

DESCRIPTION OF THE PREFERRED EMBODIMENT

The cutting tool of the present invention illustrated generally at 10 as shown has an annular type cutting tool portion 11 mounted on a shank 12 which in turn is mounted in a chuck 13 that is powered through a spindle 14 by a power source (not shown) to rotate the shank 12 and the tool 11 about the longitudinal axis of the shank. The cutting tool 11 is made so that it will cut profiles into wood or other workpieces indicated generally at 15.

The cutting tool 11 is cut from a segment of tubular steel, which is cut into the segment along two separate, nonparallel planes. The planes of cut on the opposite sides of the tube segments are not parallel to each other, and they preferably are skewed with respect to the axis of the tube from which the cutting element 11 is formed. For example, in FIGS. 3 and 4 it can be seen that the planes of cut represented by lines 20 on one side and 21 on the other, are inclined at different angles with respect to the longitudinal axis of the shank 12 and also therefore are skewed with respect to the axis of the tube indicated at 22A. The axis of the tube is perpendicular to the axis of rotation of the shank.

An examination of FIG. 4 will show that the planes are both at other than a right angle to the axis of the tube 22 in this plane of viewing, and the lines which are represented by 20A and 21A are the lines lying along the sight plane of FIG. 4 and also in the planes 20 and 21, respectively. It can be seen that as shown these lines 20A and 21A are parallel. The planes 20 and 21, as shown by lines 20A and 21A, are skewed relative to axis 22 so the angles of the lines are less than 90° on the rotationally leading side of the axis and greater than 90° on the rotationally trailing side of the axis to provide tool clearance. It should be noted that while lines have been used to represent the inclination of the planes 20 and 21, for sake of clarity the planes would appear in three dimensions in FIG. 3 because of the inclination of the lines 20A and 21A relative to axis 22.

After the cuts along planes 20 and 21 have been taken, the tube section that forms the cutting tool 11 is an annulus indicated at 23 having one wall portion 25 which has the greatest length in the direction of the axis 22 of the tube (see FIGS. 3, 4 and 6). This wall section is where the shank 12 is attached. Diametrically opposite from this longest wall portion 25, there is the narrowest or shortest wall portion 26 which is the lead-in side of the tool.

The annulus 23 may be attached to the shank 12, at the wall portion 25 with a suitable threaded member indicated at 27. Member 27 is attached to the tool in a suitable manner such as threading directly to the tubular wall or by brazing it in place. If desired a boss indicated at 28 can be formed by cutting a flat surface on the outer side of wall portion 25 which surrounds the threaded member 27 where it abuts the tubular wall portion 25. This boss provides a planar surface against which the end of the shank 12 can abut. The threaded member 27 can then be threaded into a threaded opening in the shank 12 for attachment to the shank 12 after the tool has been sharpened and heat treated.

To form the cutting tool, diagonally opposite edges of the tubular wall are sharpened with the sharpening chamfer or tapering edge formed on the interior of the tube section. The sharpening is along about 180° of arc on each side of the tube, section or annulus 23. For example, when the tool is to be rotated in normal clockwise direction, when looking along the shank 12 from the chuck end toward the cutting tool, a first tapering surface or chamfer indicated at 31 would be formed on one side of the tube section or annulus 23 to form a sharpened edge indicated at 31A that extends from slightly past the narrow wall portion 26 substantially 180° around the tube wall to near where the threaded member 27 is mounted. A second chamber or tapering surface 32 is formed on the interior of the tube section or annulus 23 to form a cutting edge 32A diagonally opposite from the surface 31. The primary portions of the sharpened edges are on opposite sides of a reference plane defined by the axis of rotation of shank 12 and the tube axis 22, shown by a dotted line 29 in FIG. 2, as well as on opposite side edges of the tube section or annulus. However, the cutting edges do overlap the reference plane 29 slightly at wall portion 26, as shown in FIG. 7.

A pair of small cuts are made on the outer surface of narrow wall portion 26 to form cutting or chipping edges. A first cut is made to form a flat surface 33 and a cutting edge 33A that provides for a shaving or lead-in lip when the cutter is rotated as indicated by the arrows 34 to permit penetration for a shaving cut by the edge 31A. A second nulling cut is made on the narrow or short wall portion 26 to form a flat surface 35 and a shoulder with a sharp cutting edge 35A that forms a lead-in to the cutting edge 32A as the cutter is rotated as shown by the arrow 34 in FIG. 6. The two flat spots 33 and 35 thus form shoulders which provide oppositely facing cutting edges that will engage work as the unit is moved downwardly into the work.

The diameter of the cut made with the tool is determined by the distance of the respective cutting edges 31A and 32A from axis 19 of the shank 12. It can be seen that because of the orientation of the planes represented by lines 20 and 21 (as shown by the angles of lines 20A and 21A which are not perpendicular to axis 22), the rotationally trailing edges on the same side of the cutting tool, that is the unsharpened edges indicated at 39 and 40 are spaced inwardly from the circles circumscribed by the edges 31A and 32A as the tool is rotated about the axis of the shank 12. This can perhaps best be seen in FIG. 6, as well as in FIGS. 4 and 7.

The narrow or short wall portion 26 formed by convergence of planes 20 and 21 to narrow down the lead-in side of the tubular cutter provides for good chip clearance. The use of sharp edges or shoulders formed by the flat surfaces 33 and 35 provide for adequate lead-in and chipping of the workpiece so that the shaving cuts made by edges 31A and 32A are made easily and the tool can cut in direction along the axis of the shank 12. In the previous devices, the use of parallel cuts on the tube to define the two sides of the tool presented a problem in chip clearance and ability to cut along the axis of the shank, which also is the axis of rotation.

It should also be noted that the axis of rotation 19 (FIGS. 3 and 4) can be offset from the exact center of the narrow or short wall portion 26 as can be noted in FIG. 3 where the axis of rotation is shown.

It should be noted now that in connection with FIG. 3, that the reference plane 29 passing through the axis 19 of the shank 12 and perpendicular to the tube axis 22 can be used as a reference, and the planes 20 and 22 should be inclined relative to the reference plane so that they taper together in direction extending away from the shank. Additionally, then, the planes used to delineate the sides of the cutting tool are skewed slightly relative to the reference plane as shown in FIG. 4. Plane 29 lies along axis 22 in FIG. 4. However, the important feature is that the two cutting planes defining the sides of the cutting tool incline toward each other in direction away from the cutting shank toward the cutting end of the tool to form a narrow wall portion diametrically opposite from the attachment of the shank to the cutting tool to provide a lead-in section. The edges of the tube are chamfered or sharpened along diagonally opposite edges to provide for a pair of arcuate cutting edges. The chamfered edges are the leading cutting edges with respect to the direction of rotation of the tool and are positioned so that the respective trailing edges on the opposite side of the tool in direction along the tube wall are at a smaller radius with respect to the axis 19 than the cutting edges.

The narrow wall portion of the tool has sharpened edges that face outwardly and which provide for chipping action. The tubular wall portion having the shortest or least axial length forms the leading end of the cutter.

What is claimed is:

1. A cutting tool for use relative to workpieces comprising an annulus of metal having a central axis around which the annulus is formed, means defining a rotational axis generally perpendicular to said central axis, said annulus of metal being defined by side edges generally lying along planes that are transverse to the central axis of the annulus and that are inclined relative to the rotational axis so that the cutting planes form a wall of the annulus that is shorter in direction parallel to the central axis at a leading end with respect to the direction of feed of said tool than the diametrically opposite wall portion, portions of said side edges being sharpened so that with respect to rotation of the annulus about the rotational axis the leading side edges are sharpened and in any plane perpendicular to the rotational axis and passing through the annulus, the leading sharpened edge is at a greater radius from the axis of rotation than the rotationally trailing side edge of the wall portion of the annulus on which the sharpened edge is formed.

2. The cutting tool as specified in claim 1 wherein the planes of the side edges of the annulus are both inclined relative to the plane perpendicular to the central axis and passing through the rotational axis in the same direction to skew the rotationally leading side edges at said greater radius from the axis of rotation than rotationally trailing side edges of the said side wall portion intersected by such planes.

3. The cutting tool of claim 2 wherein the cutting edges are on opposite sides of a plane defined by the central axis around which the annulus is formed and the rotational axis.

4. The cutting tool of claim 1 wherein the short wall section has an outwardly facing surface forming a tool leading surface and means forming chipping edges on said leading surface.

* * * * *